US006839919B2

(12) United States Patent
Pugliese, Jr. et al.

(10) Patent No.: US 6,839,919 B2
(45) Date of Patent: Jan. 11, 2005

(54) CURVILINEAR SPA FRAME

(75) Inventors: Angelo Vito Pugliese, Jr., Vista, CA (US); Victor Lee Walker, Murrieta, CA (US); Brent Mark Hutchings, Ramona, CA (US)

(73) Assignee: Dimension One Spas, Vista, CA (US)

( * ) Notice: Subject to any disclaimer, the term of this patent is extended or adjusted under 35 U.S.C. 154(b) by 0 days.

(21) Appl. No.: 10/279,379

(22) Filed: Oct. 23, 2002

(65) Prior Publication Data

US 2004/0078884 A1 Apr. 29, 2004

(51) Int. Cl.[7] ..... E04H 4/00

(52) U.S. Cl. ..... 4/506; 4/513; 4/584; 4/592; 4/593

(58) Field of Search ..... 4/488, 506, 513, 4/584, 587, 592, 593; 52/245, 169.7; D23/277

(56) References Cited

U.S. PATENT DOCUMENTS 3,317,927 A * 5/1967 Shields ..... 52/245
3,579,665 A * 5/1971 Barker ..... 52/169.7
3,736,599 A * 6/1973 Kessler et al. ..... 52/169.7
3,869,736 A * 3/1975 Valois et al. ..... 52/169.7
3,913,332 A * 10/1975 Forsman ..... 405/79
3,974,605 A * 8/1976 Beatty et al. ..... 52/481.1
4,055,922 A * 11/1977 Ellington et al. ..... 52/169.7
4,782,538 A * 11/1988 Chisholm et al. ..... 4/506
4,847,926 A * 7/1989 Laputka ..... 4/506
5,054,135 A * 10/1991 Dallaire et al. ..... 4/506
5,186,351 A * 2/1993 Gallo et al. ..... 220/563
5,325,644 A * 7/1994 Cornelius ..... 52/169.7
5,333,325 A * 8/1994 Levien et al. ..... 4/584
6,094,877 A * 8/2000 White ..... 52/247
6,226,938 B1 * 5/2001 Hodak ..... 52/169.7
6,349,427 B1 * 2/2002 Bergstrom ..... 4/541.1
6,405,386 B1 * 6/2002 Chang ..... 4/506

* cited by examiner

*Primary Examiner*—Henry Bennett
*Assistant Examiner*—Amanda Flynn
(74) *Attorney, Agent, or Firm*—Fish & Richardson P.C.

(57) ABSTRACT

A curvilinear spa frame apparatus and method that provides support to a curvilinear spa shell design, including a frame comprising a top curvilinear rail, a bottom curvilinear rail, and one or more box sections aligned to be within the confines of the curvilinear spa shell providing stiffness for the completed frame. The box sections can include sheets that align with corresponding notches in the curvilinear spa frame increasing rigidity and facilitating alignment of the spa frame components during assembly.

18 Claims, 6 Drawing Sheets

CURVILINEAR SPA FRAME

TECHNICAL FIELD

This invention relates to a curvilinear spa, and more particularly to curvilinear spa frame design to support a curvilinear spa shell.

BACKGROUND

Typical spas are designed around dimensional lumber and are usually very linear in shape. Some deviations do occur in certain models but only on one or two sides. Spas with very linear shell shapes require very linear frames that are easily constructed with dimensional lumber, like 2×4's or 2×2 lumber.

Typical linear spas are very plain looking, especially when the cover is on and they are not in use. Linear spas are not architecturally pleasing and cannot in and of themselves become a focal point for the customers' landscape architecture. Accordingly, many spa owners hide their spas with landscaping or put them inside structures such as gazebos.

It is therefore advantageous to provide the customer with a spa shell that is curvilinear in shape so that the spa is not just a box of hot water. A spa shell that has curvilinear sides necessarily requires a frame that among other things will remain square with handling and water pressure and that will fully support the bar top. Current linear spa frame designs are inadequate for a curvilinear spa shell design. A metal frame that follows the entire profile of the curvilinear spa is complex in shape and difficult to manufacture. Additionally, such a frame would be heavy. As a result, the cost associated with such a frame would be excessive.

SUMMARY

The present curvilinear spa frame invention addresses the need to provide a rigid frame to support a curvilinear spa shell design. The present invention includes a frame comprised of a bottom plate of shaped plywood or similar support material, to which can support a multiplicity of box sections aligned to be within the confines of the spa shell curves and provide stiffness for the completed frame in all directions. Atop these box sections would be affixed a multiplicity of curved pieces that form the top rail of the frame and support the spa bar top. The box sections can be given greater rigidity by the use of truss plates and associated assembly, by the use of sheet material as a stiffener or by any other fasteners.

In another embodiment of the present invention, sheet material can be used in conjunction with corresponding notches in the curved components to align the top and bottom of the frame.

The present invention provides a frame that will remain square regardless of handling and water pressure while fully supporting the bar top of the spa. It is another advantage of the present invention to fully support a curvilinear spa shell design without complicated frame components that can mimic the curvilinear shape of the bar top. It is yet another advantage of the present invention to have a frame support a curvilinear spa shell design by use of structural box elements that are not as complex in shape as the outline of the curvilinear spa shell. Another advantage of the present invention includes structural box frames that need not follow the entire circumference of the curvilinear spa outline. It is yet another advantage of the present invention that the frame components are easier to manufacture. It is another advantage of the present invention that interlocking sheet material and groove techniques or other known techniques can be utilized to make alignment of the curvilinear spa frame components easier resulting in rapid and reliable assembly and a stronger, more rigid frame. It is yet another advantage of the present invention that the bar top be supported adequately by the curvilinear top rail without necessarily requiring the use of non-standard lumber. The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
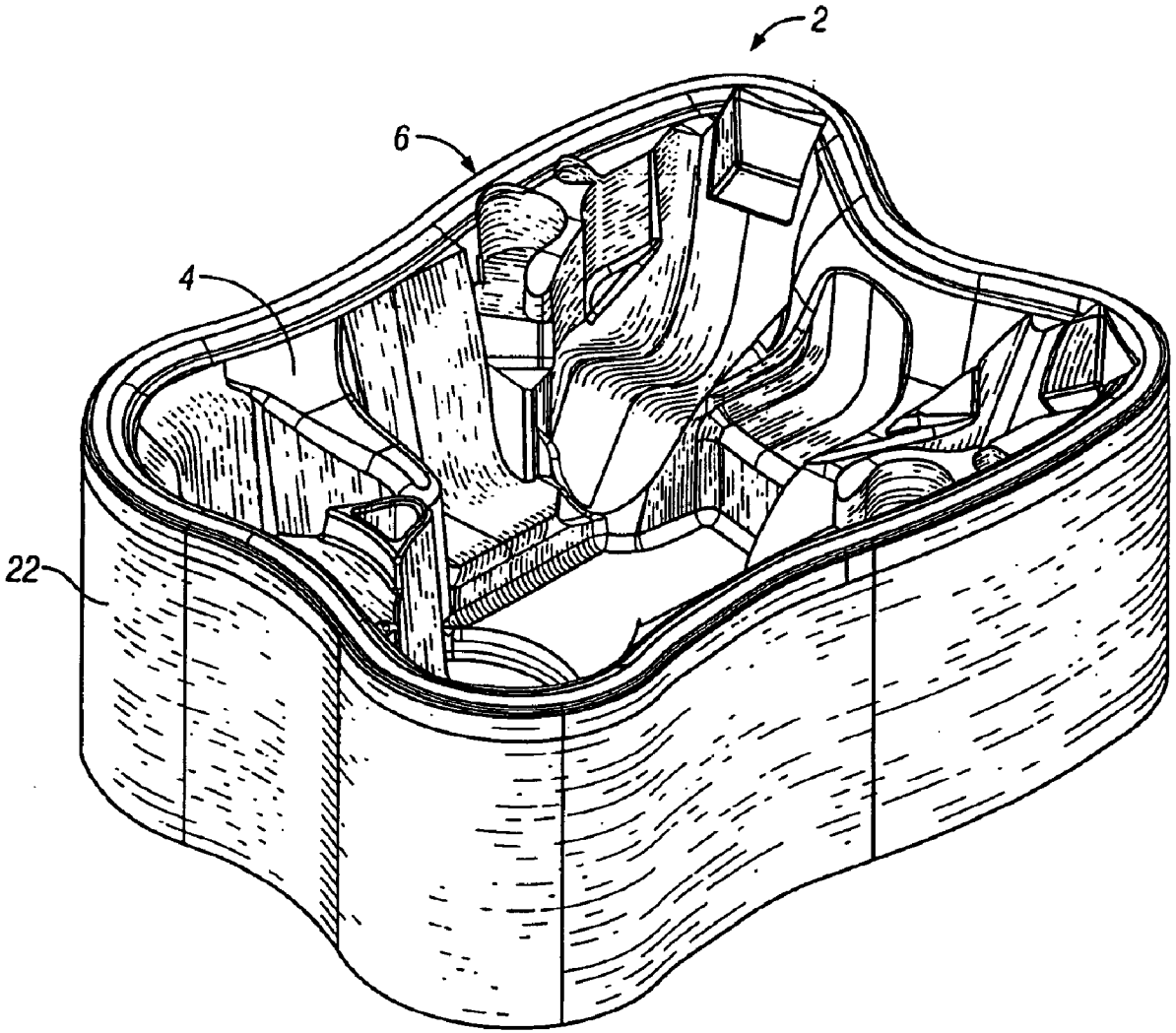
FIG. 1 is an isometric view of a curvilinear spa.

FIG. 1 depicts an embodiment of a curvilinear spa 2. Curvilinear spa 2 has an inner shell 4 that can hold water and includes support for spa users while experiencing the benefits of hydrotherapy. Bar top 6 substantially follows the contour of the curvilinear spa outline formed in part by the decorative siding 22.

Figure 2:
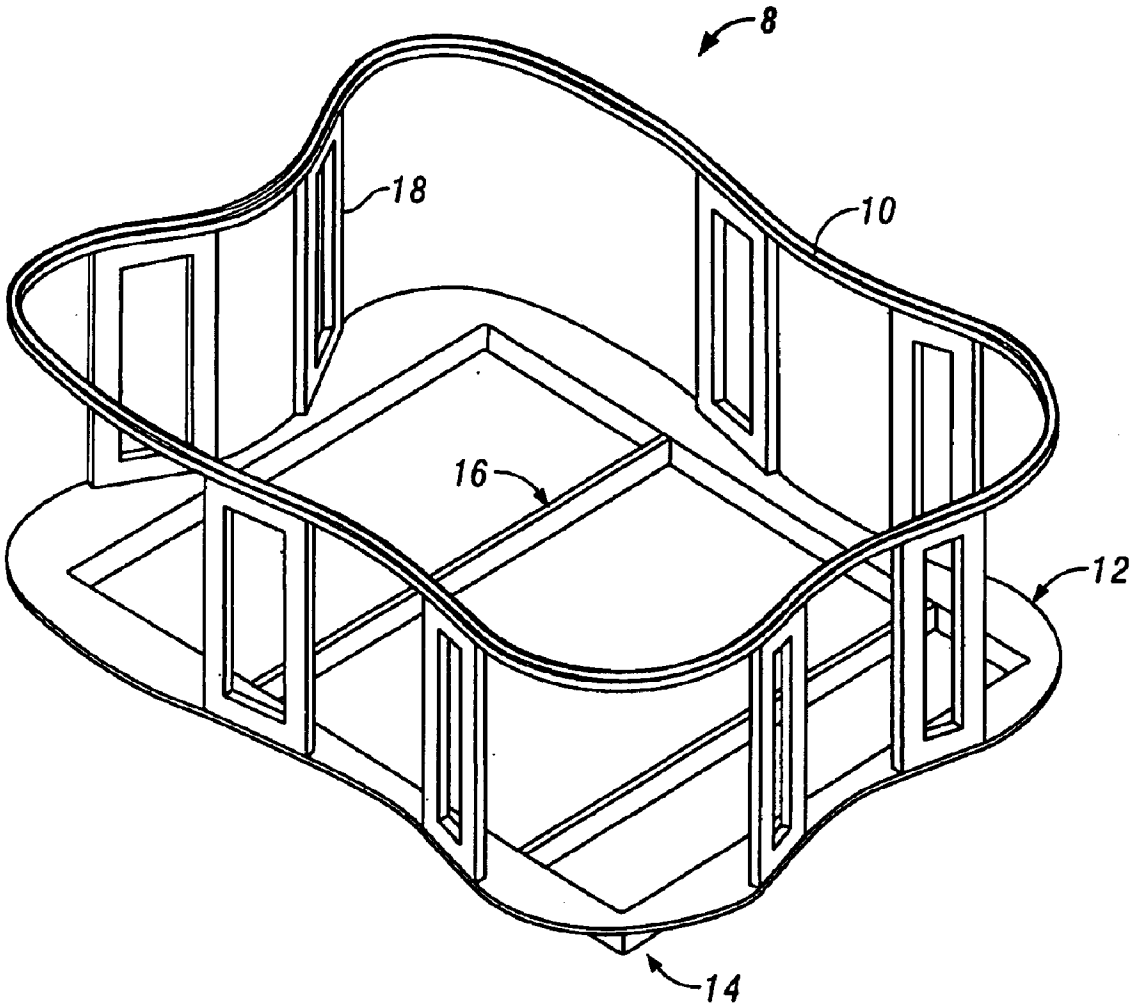
FIG. 2 is an isometric view of a curvilinear spa frame.

FIG. 2 depicts a curvilinear spa frame 8 that supports the curvilinear spa shell 4. As depicted in FIG. 2, the curvilinear spa frame 8 includes a top rail 10 and a bottom rail 12. The top rail 10 and bottom rail 12 substantially mimics the contour of the curvilinear spa 2. The top rail 10 and bottom rail 12 can be made of any material suitable for supporting the weight associated with the use of the shell 4, for example, wood, metal, composite materials like fiberglass, etc. The top rail 10 can be substantially the same shape as the bar top 6 and can support the weight associated with the bar top 6. During assembly, the top rail 10 can be aligned with and become an anchor for the bar top 6.

As depicted in FIG. 2, the bottom rail 12 can be supported by a bottom pedestal 14 or similar support structure. The bottom pedestal 14 is used to give additional stability to the frame and like the top and bottom rail, can be made of any material capable of supporting the weight of the spa, like wood, metal, composite materials like fiberglass, etc. For additional rigidity, bottom beam 16 can be secured to the opposing sides of the bottom pedestal 14. Other similar fastening techniques can be utilized as well to secure the bottom rail 12, top rail 10 and bottom pedestal 14 in a predetermined manner in order to facilitate assembly and rigidity.

As shown in FIG. 2, between top rail 10 and bottom rail 12 is a plurality of box sections 18. Box sections 18 provide rigidity to the frame structure in addition to providing support to the top rail 10. Box sections 18 are substantially linear and can be spaced intermittently substantially within the confines of the outer diameter of the curvilinear frame 8 thereby alleviating the need for more complex shaped support structures that follow the complex contours of the curvilinear spa frame 8. Box sections 18 can be prefabricated and made of any material capable of supporting the weight associated with the spa 2, like metal, wood, composite materials like fiberglass, etc.

Figure 3:
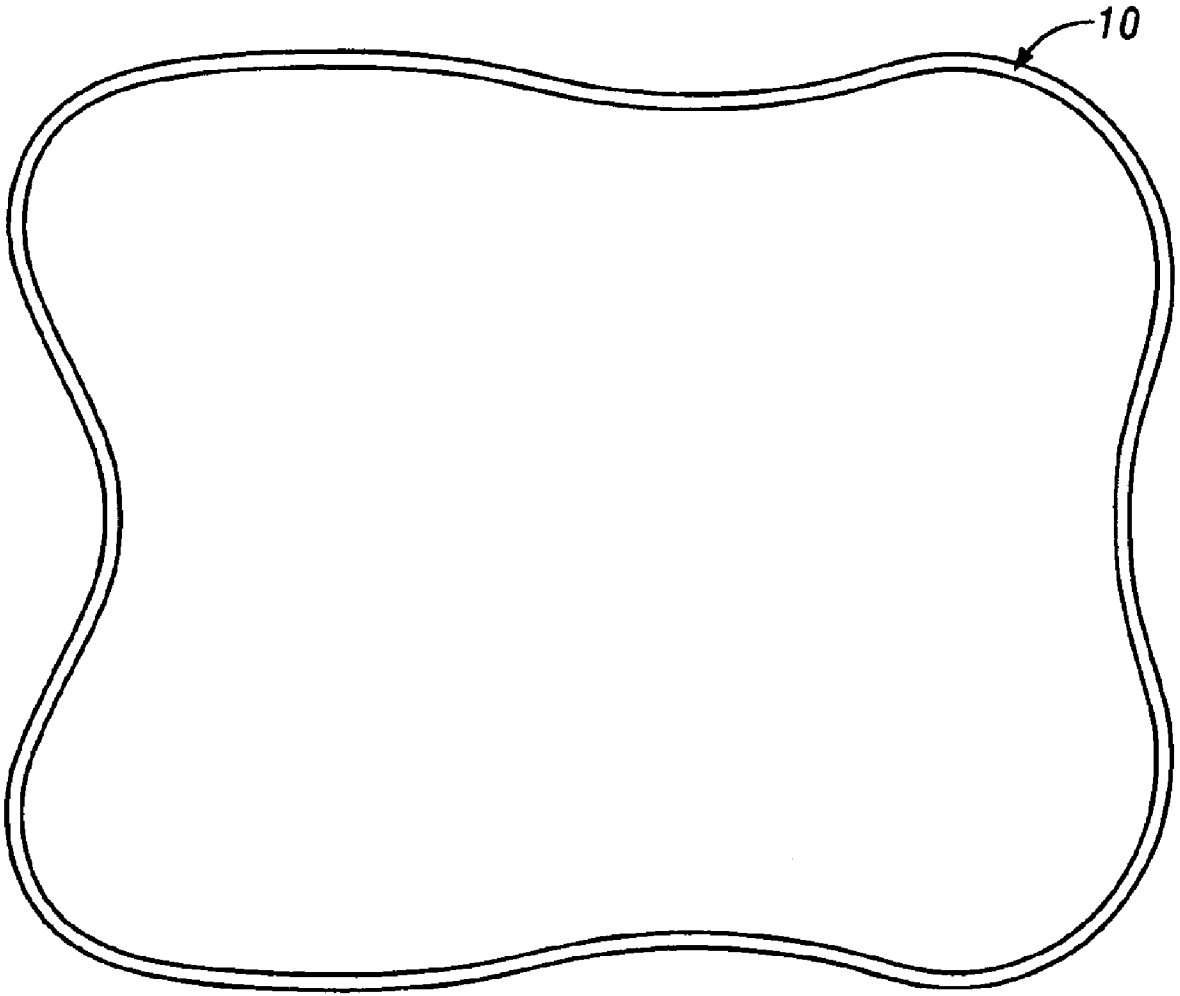
FIG. 3 is a top view of the top rail of the spa frame.

FIG. 3 depicts a top view of the top rail 10. Top rail 10 can be formed as one piece, or alternately, can be formed from a multiplicity of pieces, e.g., fabricated using a CNC machine. When the pieces are fastened, the top rail 10 is formed and becomes a structurally sound support member for the bar top 6 (not shown). If a multiplicity of overlapping pieces are utilized to fabricate top rail 10, glue, staples, or other known fasteners can be used to create an integrated top rail 10 member.

Figure 4A:
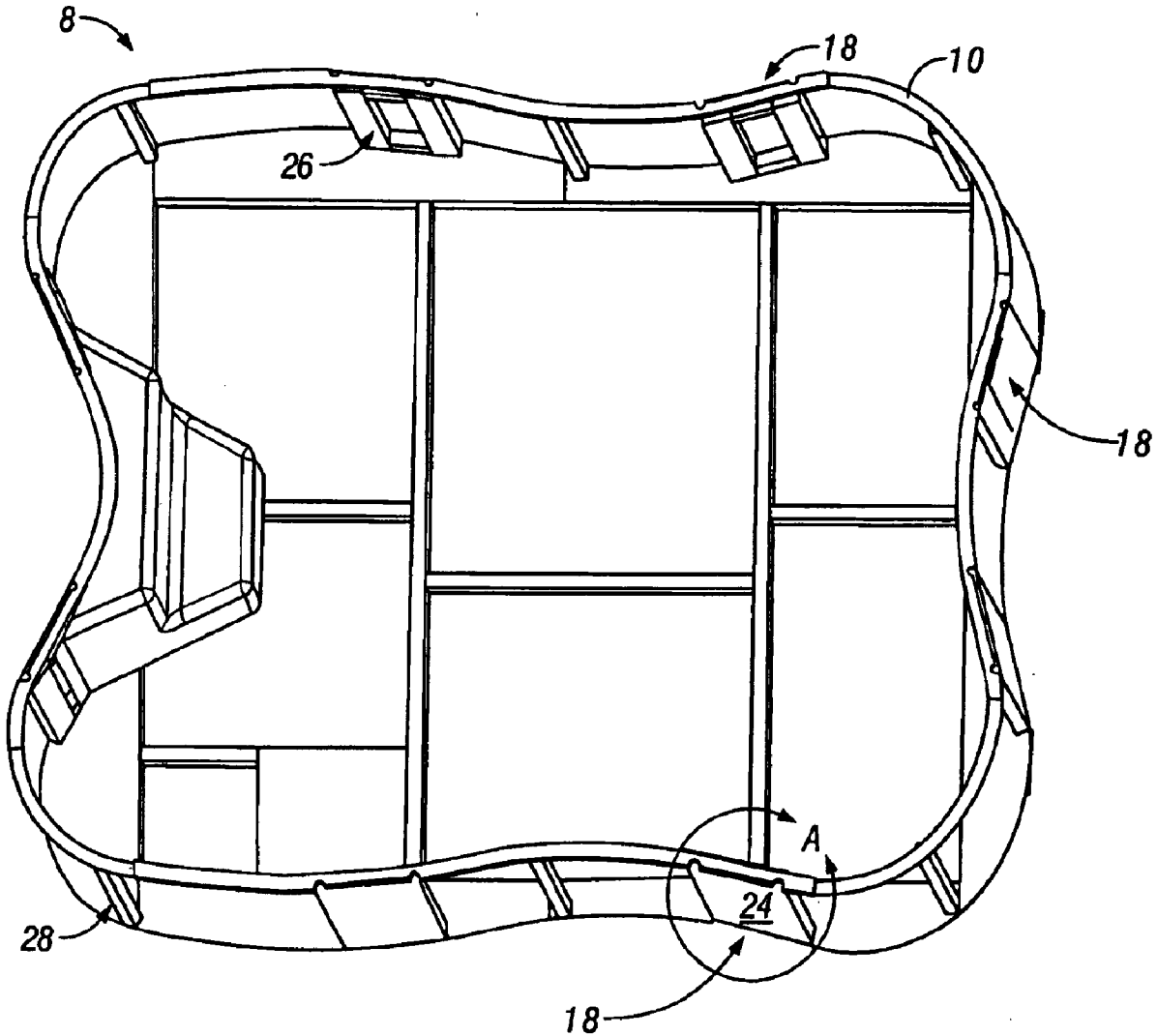
FIG. 4A is an isometric view of another embodiment of the curvilinear spa
Figure 4B:
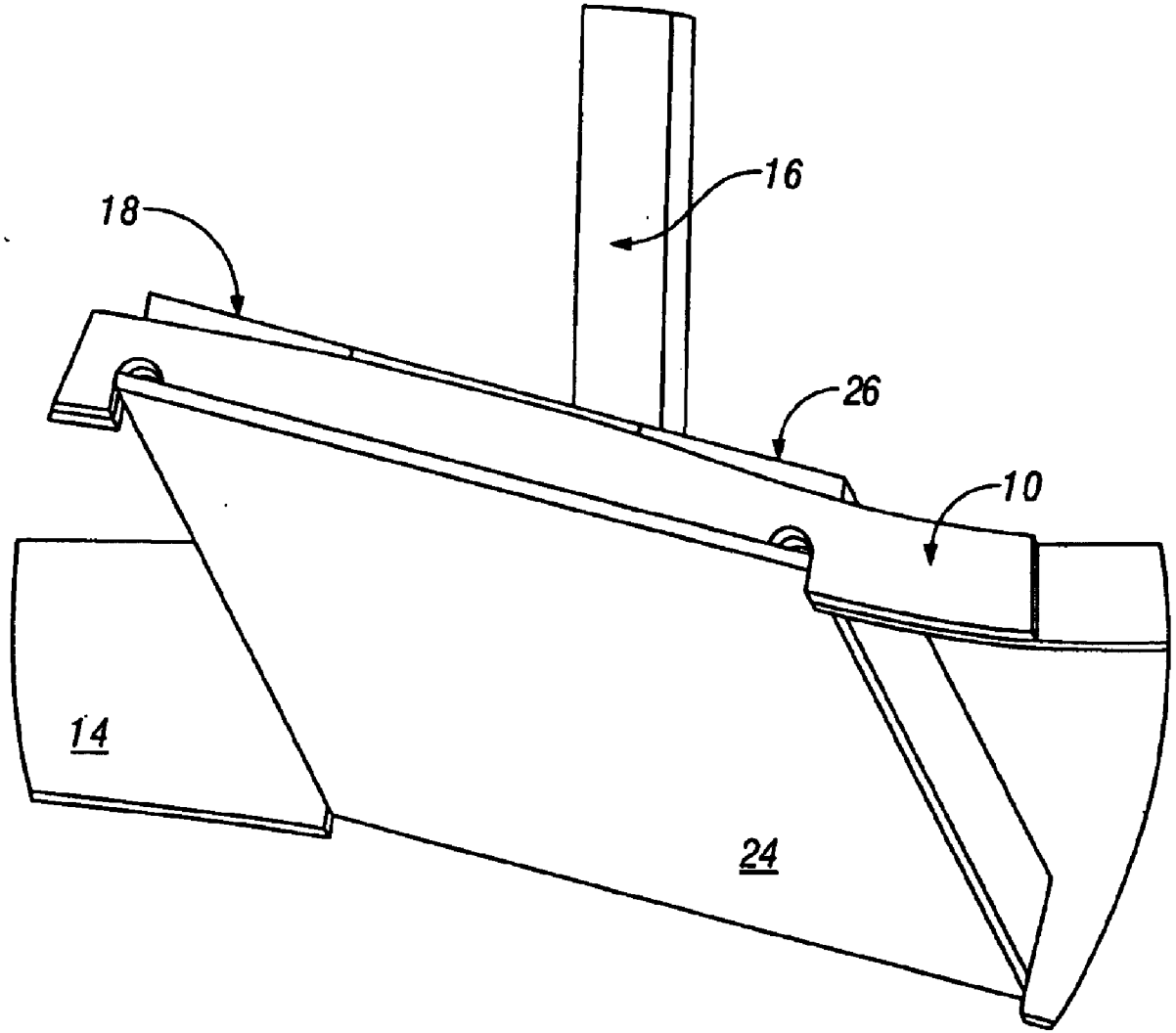
FIG. 4B is an isometric view of a box section with panel and interlocking groove.

FIGS. 4A and B depicts another embodiment of the curvilinear spa frame 8 that is easy to assemble and sufficiently rigid. As seen in FIG. 4A, the box sections 18 include a sheet 24 fastened in any known fashion to a rectangular structural member 26. As depicted in FIG. 4B, use of the sheet 24 not only improves rigidity, but also assists with alignment of curvilinear spa frame components, e.g., the top rail 10 and bottom rail 12. As depicted in FIG. 4B, the sheet 24 interlocks into notches in the top rail 10 and bottom rail 12. As a result, box section 18 can be readily inserted into the appropriate position between top rail 10 and bottom rail 12 thereby facilitating alignment of the top rail 10 and bottom rail 12. The notches can be located in various combinations of the top rail 10 and bottom rail 12, as long as the box section 18 assists alignment of the spa frame curvilinear components, e.g., the top rail 10 to the curvilinear bottom rail 12. Other fastening techniques can be utilized, e.g., predetermined placement of holes in the top and bottom rails with associated pegs on the top and bottom of the box section 12 (not shown). Additionally, strategic use of any modern fasteners, e.g., predetermined placement of pieces of sheet metal also may be used to ensure that corresponding box sections 18 are secured at corresponding predetermined locations in the curvilinear spa frame during assembly, thereby facilitating alignment of the curvilinear spa frame components. Those of skill in the art will appreciate the fact that many different types of interlocking construction can be utilized, e.g., pegs and holes, interlocking sheet material and notches, etc. The interlocking construction can be located on any and/or all curvilinear frame components to improve rigidity and increase ease of assembly. As depicted in FIG. 4A, additional supports 28, in this case 2×2s, can be included in the curvilinear spa frame 8 as needed to increase rigidity.

Figure 5:
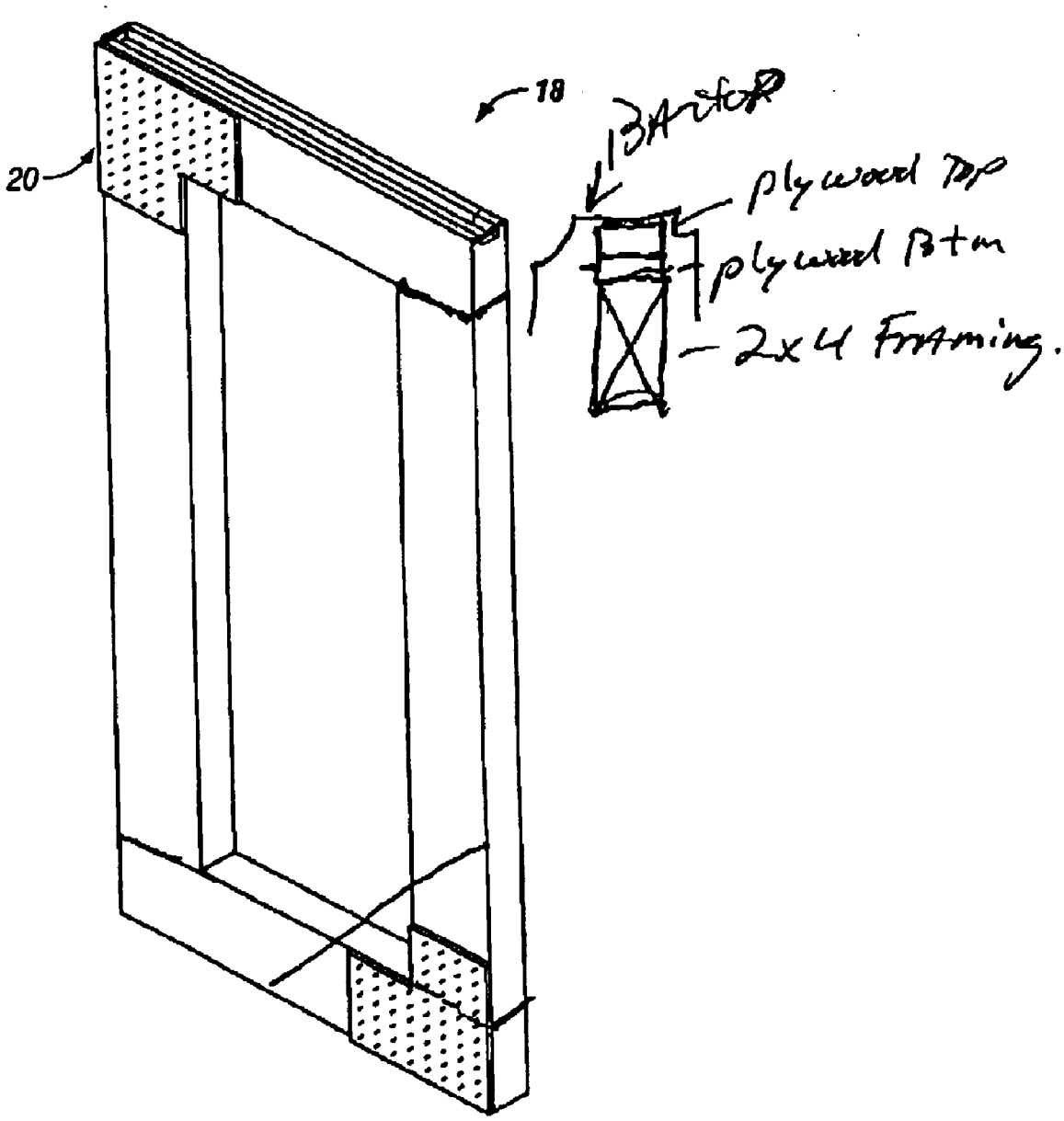
FIG. 5 is a box section with truss.
Figure 5:
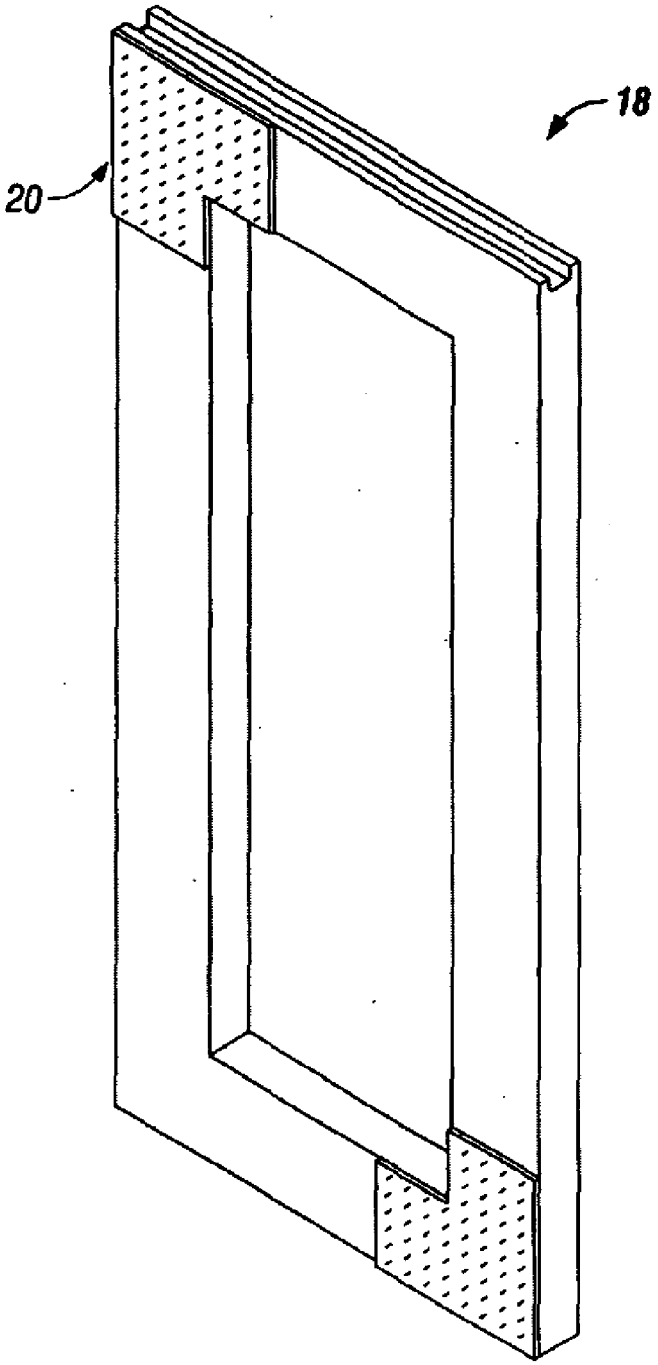

To further increase structural rigidity, FIG. 5 depicts the use of truss plates 20 on box section 18. If more rigidity is desired, additional truss plates 20 can be added. Typically, truss plates are made of sheets of galvanized steel and are secured into the box sections using pressure during fabrication.

Moreover, increasing the strength of the box sections 18 may advantageously reduce the number of box sections 18 required to maintain the rigidity associated with the spa 2. To further reduce the number of box sections 18 required, additional supports 28 as depicted in FIG. 4A can be added.

A number of embodiments of the invention have been described. Nevertheless, it will be understood that various modifications may be made without departing from the spirit and scope of the invention. For example, additional structural members may be added to the curvilinear spa frame 8 to increase rigidity. Moreover, various fastener and bracing technologies can be incorporated into the curvilinear spa frame design, e.g., hangers and plates, angle braces and gussets to brace the fame along various axis, framing connectors, spacers, etc. Such components can be located, for example, between the box sections and the top rail 10, or alternately between the box sections 18 and bottom rail 12 without departing from the spirit of the invention. Additionally, those of skill in the art will appreciate that depending on the size, shape and strength of each box section, more or less box sections 18 can be included into the curvilinear spa frame than discussed or depicted. Furthermore, box sections can be many shapes and sizes and can have a variety of interlocking mechanisms located on various sections of the spa frame, not just the top rail 10 and/or bottom rail 12. Accordingly, other embodiments are within the scope of the following claims.

What is claimed is:

1. A frame for supporting a curvilinear spa shell comprising:

a curvilinear top rail;

a curvilinear bottom rail substantially parallel to and disposed below said top rail;

at least one box section disposed between the tap rail and bottom rail, said box section substantially within the confines of the outer diameter of said top rail, wherein said box section supports vertical load of the curvilinear spa shell when the curvilinear spa shell rests on the top rail and said box section comprising an individual pillar support to transfer load from the top rail to the bottom rail.

2. The frame of claim 1 wherein said top rail further includes notches for aligning the position of each of said box section relative to said top rail and bottom rail.

3. The frame of claim 1 wherein said box sections further include interlocking means for aligning said top rail and said bottom rail during assembly.

4. The frame of claim 1 wherein said top rail further includes holes adapted to interlock with said box sections so as to facilitate alignment of the contours of said top rail and bottom rail.

5. The frame of claim 1 further including sheets affixed to said box section for increasing rigidity of said curvilinear spa frame.

6. The frame of claim 1 wherein said curvilinear top rail is comprised of multiple pieces of pre-fabricated material fastened into one structural member.

7. The frame of claim 1 further including at least one support member having an upper portion and a lower portion, said support member supporting said top rail at said upper portion and said bottom rail supporting said lower portion, said support member for increasing rigidity of said spa frame.

8. The frame of claim 1 further including a bottom pedestal located beneath said bottom rail, said bottom pedestal for supporting said curvilinear spa frame.

9. A frame for supporting a spa having a curvilinear spa shell, a bar top and decorative siding, said frame comprising:

a top rail means for supporting said bar top, said top rail means for supporting having substantially the same contour as the upper portion of the spa shell;

a bottom rail means for transferring the load associated with the spa shell, said bottom rail means for transferring having substantially the same contour as the top rail means for supporting, said bottom rail means for transferring substantially parallel to and disposed below said top rail means for supporting;

box section means for supporting vertical load of the curvilinear spa shell when the curvilinear spa shell rests on said top rail means for supporting, said box section means for supporting located substantially within the confines of the curvilinear contour formed by the outer diameter of the top rail means for supporting and the bottom rail means for transferring, and said box section means for supporting comprising individual pillar support means for transferring load from the top rail means for supporting to the bottom rail means for transferring.

10. The frame of claim 9 wherein said top rail means for supporting further includes interlocking means for receiving said box section means for supporting so as to facilitate alignment of the contours of said top rail means for supporting.

11. The frame of claim 9 wherein said bottom rail means for transferring and said top rail means for supporting further include interlocking means for receiving said box section means for supporting so as to facilitate alignment of the contours of said top rail means for supporting and said bottom rail means for transferring.

12. A frame for supporting a spa having a curvilinear spa shell, and a bar top, said frame comprising:

a top rail having substantially the same contour as the upper portion of said spa shell;

a bottom rail having substantially the same contour as the top rail, said bottom rail substantially parallel to and disposed below said top rail;

a plurality of box sections disposed between said top and bottom rail, wherein said box sections vertically support load of the curvilinear spa shell when the curvilinear spa shell rests on the top rail, said plurality of box sections substantially within the confines of an axis formed perpendicular to the outer diameter of said top and bottom rails and said box sections comprising individual pillar supports to transfer load from the top rail to the bottom rail.

13. The frame of claim 12 wherein said top rail includes notches for receiving said box sections and said top rail is a single structural member comprised of a plurality of prefabricated materials fastened together.

14. The frame of claim 12 wherein said box sections comprise four interconnected members forming a rectangular outer perimeter, said box section further including a sheet attached to said members and extending slightly beyond said outer perimeter on at least one side, said sheet adapted for interlocking into said spa frame thereby facilitating alignment of the said top rail and said bottom rail.

15. A method of assembling a spa frame for supporting a spa having a curvilinear spa shell, a bar top and decorative siding sections, said method comprising:

placing a bottom rail on a support surface;

aligning the outer diameter of a top rail above and substantially parallel to said bottom rail so that both said rails have substantially the same contour as the upper portion of said spa shell;

securing at least one box section between said top and bottom rail, wherein said box sections support vertical load of the curvilinear spa shell when the curvilinear spa shell rests on the top rail, said box section adapted substantially within the confines of an axis formed perpendicular to the outer diameter of said top and bottom curvilinear rails, said box section intermittently spaced for supporting the load associated with the curvilinear spa and said box section comprising an individual pillar support to transfer load from the top rail to the bottom rail.

16. The method of claim 15 wherein said box section interlocks with notches located on said top rail thereby aligning the position of box section relative to said top rail and bottom rail.

17. The method of claim 15 wherein said box section interlocks with notches located on said top rail and notches on said bottom rail, said box section thereby aligning the position of said box section relative to said top rail and bottom rail.

18. The method of claim 15 further including the step of inserting at least one support member having an upper portion and lower portion, said support member inserted between said top rail at said upper portion and said bottom rail at said lower portion, said support member for increasing rigidity of said spa frame.

* * * * *

UNITED STATES PATENT AND TRADEMARK OFFICE

CERTIFICATE OF CORRECTION

PATENT NO. : 6,839,919 B2 
DATED : January 11, 2005
INVENTOR(S) : Angelo Vito Pugliese, Jr., Victor Lee Walker and Brent Mark Hutchings It is certified that error appears in the above-identified patent and that said Letters Patent is hereby corrected as shown below:

Drawings,
Please substitute the attached FIG. 5 for the informal FIG. 5 in the patent.

Column 4,
Line 21, please delete “tap” and insert -- top --.

Signed and Sealed this

Tenth Day of May, 2005

JON W. DUDAS
*Director of the United States Patent and Trademark Office*